US009883290B2

(12) United States Patent
Timothy et al.

(10) Patent No.: US 9,883,290 B2
(45) Date of Patent: Jan. 30, 2018

(54) AUDIO DRIVER ASSEMBLY, HEADPHONE INCLUDING SUCH AN AUDIO DRIVER ASSEMBLY, AND RELATED METHODS

(71) Applicant: Skullcandy, Inc., Park City, UT (US)

(72) Inventors: John Timothy, Salt Lake City, UT (US); Sam Noertker, Park City, UT (US)

(73) Assignee: Skullcandy, Inc., Park City, UT (US)

( * ) Notice: Subject to any disclaimer, the term of this patent is extended or adjusted under 35 U.S.C. 154(b) by 0 days.

(21) Appl. No.: 14/960,678

(22) Filed: Dec. 7, 2015

(65) Prior Publication Data

US 2016/0192078 A1 Jun. 30, 2016

Related U.S. Application Data

(60) Provisional application No. 62/099,024, filed on Dec. 31, 2014.

(51) Int. Cl.

| | |
|---|---|
| ***H04R 9/04*** | (2006.01) |
| ***H04R 1/10*** | (2006.01) |
| ***H04R 7/18*** | (2006.01) |
| ***H04R 11/02*** | (2006.01) |
| *H04R 9/02* | (2006.01) |

(52) U.S. Cl.

CPC ..... *H04R 9/045* (2013.01); *H04R 1/1075* (2013.01); *H04R 7/18* (2013.01); *H04R 11/02* (2013.01); *G10K 2210/1081* (2013.01); *H04R 1/1008* (2013.01); *H04R 9/025* (2013.01)

(58) Field of Classification Search

CPC ..... H04R 9/045; H04R 11/02; H04R 1/1075; H04R 7/18; H04R 1/1008; G10K 2210/1081

USPC ..... 371/371

See application file for complete search history.

(56) References Cited

U.S. PATENT DOCUMENTS

| | | | |
|---|---|---|---|
| 3,311,712 | A | 3/1967 | Cain |
| 3,449,531 | A | 6/1969 | Ashworth |
| 4,418,248 | A | 11/1983 | Mathis |
| 4,951,270 | A | 8/1990 | Andrews |
| 5,333,206 | A | 7/1994 | Koss |
| 5,546,469 | A | 8/1996 | Donahoe |
| 5,729,605 | A | 3/1998 | Bobisuthi et al. |

(Continued)

FOREIGN PATENT DOCUMENTS

| | | | |
|---|---|---|---|
| EP | 1441560 | A1 | 7/2004 |
| GB | 2000941 | A | 1/1979 |

(Continued)

OTHER PUBLICATIONS

Noertker et al., U.S. Appl. No. 61/692,570 entitled Speakers, Headphones, and Kits Related to Vibrations in an Audio System, and Methods for Forming Same, filed Aug. 23, 2012.

(Continued)

*Primary Examiner* — Davetta W Goins
*Assistant Examiner* — Oyesola C Ojo
(74) *Attorney, Agent, or Firm* — TraskBritt

(57) ABSTRACT

An audio driver assembly comprises a driver housing and an audio driver secured within the driver housing. The audio driver comprises a magnet assembly, a flexible diaphragm overlying the magnet assembly, and a spacer between the magnet assembly and the flexible diaphragm. A headphone and a method of forming a headphone are also described.

18 Claims, 3 Drawing Sheets

(56) References Cited

U.S. PATENT DOCUMENTS

| | | | | |
|---|---|---|---|---|
| 5,740,254 | A | 4/1998 | Thompson et al. | |
| 5,913,815 | A | 6/1999 | Ball et al. | |
| 6,038,330 | A | 3/2000 | Meucci, Jr. | |
| 6,263,085 | B1 | 7/2001 | Weller | |
| RE37,398 | E | 10/2001 | Nageno | |
| 6,356,644 | B1 | 3/2002 | Pollak | |
| 6,522,759 | B1 | 2/2003 | Mori | |
| 6,600,938 | B1 * | 7/2003 | Suzuki | B06B 1/045 340/384.1 |
| 6,658,121 | B1 | 12/2003 | Konig | |
| 6,817,440 | B1 | 11/2004 | Kim | |
| 7,006,651 | B2 | 2/2006 | Ueki | |
| 7,061,327 | B2 | 6/2006 | Doy | |
| 7,095,867 | B2 | 8/2006 | Schul et al. | |
| 7,289,641 | B2 | 10/2007 | Yang | |
| 7,298,862 | B2 | 11/2007 | Dedieu et al. | |
| 7,324,655 | B2 | 1/2008 | Sato | |
| 7,340,071 | B2 | 3/2008 | Huang | |
| 7,386,137 | B2 | 6/2008 | Combest | |
| 7,463,748 | B2 | 12/2008 | Yang | |
| 7,654,361 | B2 | 2/2010 | Combest | |
| 7,876,912 | B2 | 1/2011 | Liu et al. | |
| 7,983,437 | B2 | 7/2011 | Wong et al. | |
| 8,000,490 | B2 | 8/2011 | Yang | |
| 8,965,028 | B2 | 2/2015 | Dishi et al. | |
| 2003/0103637 | A1 | 6/2003 | Huang | |
| 2004/0109576 | A1 | 6/2004 | You et al. | |
| 2005/0053245 | A1 | 3/2005 | Hsu et al. | |
| 2005/0238189 | A1 | 10/2005 | Tsai | |
| 2005/0238197 | A1 * | 10/2005 | Chang | H04R 9/06 381/396 |
| 2006/0093179 | A1 | 5/2006 | Desimone et al. | |
| 2007/0230719 | A1 | 10/2007 | Filo et al. | |
| 2008/0049959 | A1 | 2/2008 | Yang | |
| 2008/0166005 | A1 | 7/2008 | Terlizzi et al. | |
| 2008/0219491 | A1 | 9/2008 | Ahuja | |
| 2009/0136075 | A1 | 5/2009 | Meyer | |
| 2009/0147982 | A1 | 6/2009 | Ashida et al. | |
| 2009/0226023 | A1 * | 9/2009 | Akino | H04R 1/1008 381/374 |
| 2009/0279729 | A1 | 11/2009 | Huang | |
| 2010/0046783 | A1 | 2/2010 | Huang | |
| 2010/0054508 | A1 | 3/2010 | Yang | |
| 2011/0038503 | A1 | 2/2011 | Yang | |
| 2011/0150262 | A1 | 6/2011 | Nakama et al. | |
| 2011/0158440 | A1 | 6/2011 | Mei et al. | |
| 2011/0243370 | A1 * | 10/2011 | Wang | H04R 11/02 381/423 |
| 2014/0163439 | A1 | 6/2014 | Uryash et al. | |
| 2015/0189441 | A1 | 7/2015 | Oishi et al. | |
| 2016/0192087 | A1 * | 6/2016 | van Halteren | H04R 23/02 381/312 |

FOREIGN PATENT DOCUMENTS

| | | | | |
|---|---|---|---|---|
| JP | 5754500 | A | 3/1982 | |
| WO | 0219759 | A1 | 3/2002 | |
| WO | WO-0219759 | * | 3/2002 | H04R 1/00 |

OTHER PUBLICATIONS

Oishi et al., U.S. Appl. No. 61/921,979 entitled Headphones for Stereo Tactile Vibration, and Related Systems and Methods, filed Dec. 30, 2013.

Price, Rex, U.S. Appl. No. 62/029,393 entitled Mass Port Plug for Customizing Headphone Drivers, and Related Methods, filed Jul. 25, 2014.

Price, Rex, U.S. Appl. No. 14/802,360 entitled Mass Prot Plug for Customizing Headphone Drivers, and Related Methods, filed Jul. 17, 2015.

Extended European Search Report for European Application No. 15201842.0 dated Feb. 11, 2016, 10 pages.

European Office Action for European Application No. 15201842.0 dated Aug. 28, 2017, 9 pages.

* cited by examiner

AUDIO DRIVER ASSEMBLY, HEADPHONE INCLUDING SUCH AN AUDIO DRIVER ASSEMBLY, AND RELATED METHODS

CROSS-REFERENCE TO RELATED APPLICATION

This application claims the benefit of U.S. Provisional Patent Application Ser. No. 62/099,024, filed Dec. 31, 2014, titled "AUDIO DRIVER ASSEMBLY, HEADPHONE INCLUDING SUCH AN AUDIO DRIVER ASSEMBLY, AND RELATED METHODS," the disclosure of which is hereby incorporated herein in its entirety by this reference.

FIELD

The disclosure, in various embodiments, relates generally to audio driver assemblies, to headphones including audio driver assemblies, and to related methods of forming headphones. More specifically, embodiments of the disclosure relate to audio driver assemblies including an audio driver having a spacer between a magnet assembly and a flexible diaphragm, to headphones including such audio driver assemblies, and to methods of forming such headphones.

BACKGROUND

Conventional headphones include two ear-cup housings each including an audio driver assembly having an audio driver that produces audible sound waves. The audio driver may, for example, include a magnet/coil assembly secured within a driver housing, and a flexible diaphragm directly adjacent the magnet/coil assembly and attached to the driver housing. The positive and negative electrical terminals for the audio driver are respectively soldered to ends of wires, which extend to an audio jack (e.g., a tip-sleeve (TS) connector, a tip-ring-sleeve (TRS) connector, a tip-ring-ring-sleeve (TRRS) connector, etc.). The audio jack may be coupled to a media player such as a mobile phone, a digital media player, a computer, a television, etc., and the audio signal is transmitted to the audio driver in the audio driver assembly within the headphone through the wires.

The acoustic performance of a headphone is conventionally a function of both the audio driver, as well as the configuration of the audio driver assembly and the ear-cup housing within which the driver is disposed. The audio driver assembly and the ear-cup housing of conventional headphones typically define acoustical cavities that affect the acoustics of the headphone. Thus, the manufacturer of the headphones may design the ear-cup housing and audio driver assembly of a headphone, for use with a selected audio driver, so as to provide the headphone with acoustics deemed desirable by the manufacturer.

BRIEF SUMMARY

In accordance with one embodiment described herein, an audio driver assembly comprises a driver housing and an audio driver secured within the driver housing. The audio driver comprises a magnet assembly, a flexible diaphragm overlying the magnet assembly, and a spacer between the magnet assembly and the flexible diaphragm.

In additional embodiments, a headphone comprises an ear-cup housing and an audio driver assembly disposed at least partially within the ear-cup housing. The audio driver assembly comprises a driver housing, a flexible diaphragm suspended from the driver housing, a magnet assembly underlying the diaphragm, and a spacer between the flexible diaphragm and the magnet assembly. The magnet assembly comprises a permanent magnet, a voice coil circumscribing the permanent magnet, and a yoke cup at least partially surrounding the permanent magnet and the voice coil.

In additional embodiments, a method of forming a headphone comprises forming an audio driver assembly, and attaching the audio driver assembly within an ear-cup housing. The audio driver assembly comprises a driver housing, a flexible diaphragm suspended from the driver housing, a magnet assembly underlying the diaphragm, and a spacer between the flexible diaphragm and the magnet assembly. The magnet assembly comprises a permanent magnet, a voice coil circumscribing the permanent magnet, and a yoke cup at least partially surrounding the permanent magnet and the voice coil.

DETAILED DESCRIPTION

Figure 1:
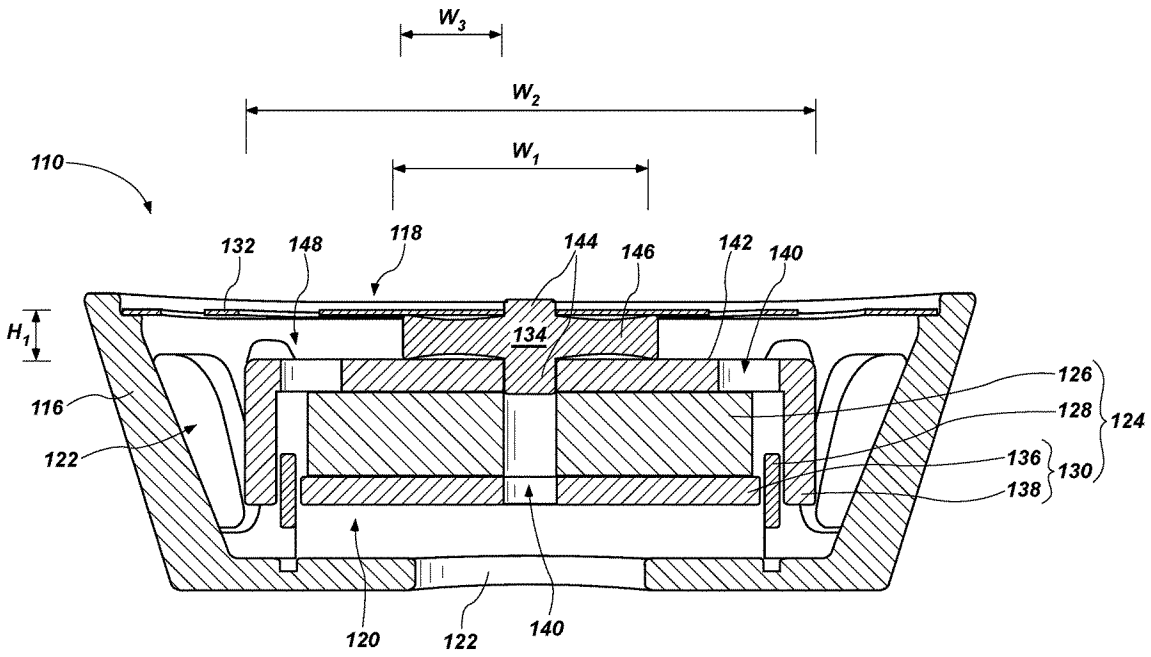
FIG. 1 is a simplified cross-sectional side view illustrating an audio driver assembly, in accordance with an embodiment of disclosure.

Audio driver assemblies are disclosed, as are headphones including audio driver assemblies, and methods of forming headphones. In some embodiments, an audio driver assembly includes an audio driver secured within a driver housing. The audio driver may comprise a magnet assembly, a flexible diaphragm overlying the magnet assembly, and a spacer positioned between (e.g., directly between) the magnet assembly and the flexible diaphragm. The spacer may facilitate vibration of the flexible diaphragm according to movements of one of more components of the magnet assembly responsive to fluctuations in a magnetic field produced by a voice coil of the magnet assembly. The spacer may define a space between the flexible diaphragm and the magnet assembly facilitating increased movement (e.g., upward movement, downward movement) as compared to a conventional audio driver wherein the spacer is not present (e.g., audio driver assemblies wherein the flexible diaphragm is directly adjacent the magnet assembly). The spacer may permit the audio driver to exhibit enhanced sensitivity and lower resonant frequencies as compared to many conventional audio drivers.

The following description provides specific details, such as material compositions and processing conditions, in order to provide a thorough description of embodiments of the present disclosure. However, a person of ordinary skill in the art would understand that the embodiments of the disclosure may be practiced without employing these specific details. Indeed, the embodiments of the disclosure may be practiced in conjunction with conventional audio assembly fabrication techniques employed in the industry. In addition, the description provided below does not form a complete process flow for manufacturing an audio driver assembly or audio device (e.g., headphone). The structures and assemblies described below do not form a complete audio device. Only those process acts and structures necessary to understand the embodiments of the disclosure are described in detail below. Additional acts to form a complete audio device from the structures and assemblies described herein may be performed by conventional fabrication processes.

Drawings presented herein are for illustrative purposes only, and are not meant to be actual views of any particular material, component, structure, device, or system. Variations from the shapes depicted in the drawings as a result, for example, of manufacturing techniques and/or tolerances, are to be expected. Thus, embodiments described herein are not to be construed as being limited to the particular shapes or regions as illustrated, but include deviations in shapes that result, for example, from manufacturing. For example, a region illustrated or described as box-shaped may have rough and/or nonlinear features, and a region illustrated or described as round may include some rough and/or linear features. Moreover, sharp angles that are illustrated may be rounded, and vice versa. Thus, the regions illustrated in the figures are schematic in nature, and their shapes are not intended to illustrate the precise shape of a region and do not limit the scope of the present claims. The drawings are not necessarily to scale. Additionally, elements common between figures may retain the same numerical designation.

As used herein, the terms "comprising," "including," "containing," "characterized by," and grammatical equivalents thereof are inclusive or open-ended terms that do not exclude additional, unrecited elements or method steps, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be, excluded.

As used herein, the singular forms "a," "an," and "the" are intended to include the plural forms as well, unless the context clearly indicates otherwise.

As used herein, "and/or" includes any and all combinations of one or more of the associated listed items.

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "below" or "beneath" or "under" or "on bottom of" other elements or features would then be oriented "above" or "on top of" the other elements or features. Thus, the term "below" can encompass both an orientation of above and below, depending on the context in which the term is used, which will be evident to one of ordinary skill in the art. The materials may be otherwise oriented (e.g., rotated 90 degrees, inverted, flipped, etc.) and the spatially relative descriptors used herein interpreted accordingly.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

As used herein, the term "configured" refers to a size, shape, material composition, and arrangement of one or more of at least one structure and at least one apparatus facilitating operation of one or more of the structure and the apparatus in a predetermined way.

FIG. 1 is a simplified cross-sectional view illustrating an audio driver assembly 110, in accordance with an embodiment of the disclosure. The audio driver assembly 110 includes a driver housing 116, and an audio driver 118 secured within the driver housing 116. The audio driver 118 may include a spacer 134 between a magnet/coil assembly 124 and a flexible diaphragm 132, as described in further detail below. While FIG. 1 depicts a particular configuration of the audio driver assembly 110, one of ordinary skill in the art will appreciate that different audio driver assembly configurations are known in the art that may be adapted to be employed in embodiments of the disclosure. FIG. 1 illustrates just one non-limiting example of the audio driver assembly 110.

The driver housing 116 may be configured to be secured within an outer ear-cup housing of an ear-cup assembly, and includes at least one structure configured to at least partially enclose and support the audio driver 118. The driver housing 116 may be positioned over one or more sides (e.g., at least a back side) of the audio driver 118. An acoustical cavity 120 may be disposed between the driver housing 116 and the one or more sides of the audio driver 118. The driver housing 116 may also exhibit one or more apertures 122 (e.g., ports, holes, etc.) extending therethrough. The location and configuration (e.g., size, shape, etc.) of each of the apertures 122 may be selected to provide a desired emitted sound pressure level (SPL) profile, and/or a desired detectable SPL profile, for the audio driver assembly 110 and a headphone including the audio driver assembly 110. The driver housing 116 may be formed of and include at least one of a metal material (e.g., a metal, a metal alloy, etc.) and a polymer material (e.g., a plastic).

The audio driver 118 includes the magnet/coil assembly 124, the flexible diaphragm 132 overlying the magnet/coil assembly 124, and the spacer 134 disposed (e.g., intervening) between the magnet/coil assembly 124 and the flexible diaphragm 132. One or more components (e.g., the magnet/coil assembly 124, the flexible diaphragm 132, etc.) of the audio driver 118 may be coupled (e.g., directly coupled, indirectly coupled, or a combination thereof) to one or more portions of the driver housing 116 using, for example, an adhesive, a snap-fit, a welding process, or any other suitable method.

The magnet/coil assembly 124 may include a permanent magnet 126, a voice coil 128 circumscribing the permanent magnet 126, and a yoke cup 130 at least partially surrounding the permanent magnet 126 and the voice coil 128. As shown in FIG. 1, the permanent magnet 126 may be located on (e.g., directly physically contact, abut, etc.) a lower portion 136 of the yoke cup 130, and an upper portion 138 of the yoke cup 130 may be located on an upper surface of the permanent magnet 126. The upper portion 138 of the yoke cup 130 may at least partially extend over and surround (e.g., cover, envelop, etc.) peripheral sidewalls (e.g., outer sidewalls) of each of the permanent magnet 126 and the lower portion 136 of the yoke cup 130. At least a portion of the voice coil 128 may be located within a cavity at least partially defined by inner sidewalls of the upper portion 138 of the yoke cup 130 and the peripheral sidewalls of each of the permanent magnet 126 and the lower portion 136 of the yoke cup 130. The voice coil 128 may be offset (e.g., spaced apart, separated, etc.) from each of the permanent magnet 126 and the yoke cup 130, and may be electrically coupled to conductive terminals of the audio driver 118. The voice coil 128 may be formed of and include an electrically conductive material, such as a metal material (e.g., a metal, a metal alloy, etc.). In addition, as depicted in FIG. 1, one or more apertures 140 (e.g., ports, holes, etc.) may extend through the yoke cup 130 (e.g., at least one of the upper portion 138 of the yoke cup 130 and the lower portion 136 of the yoke cup 130) and/or the permanent magnet 126.

The flexible diaphragm 132 may be positioned over the upper portion 138 of the yoke cup 130 of the magnet/coil assembly 124. At least a peripheral portion (e.g., an outer rim) of the flexible diaphragm 132 may be attached (e.g., coupled, bonded, adhered, connected, etc.) to an upper portion of the driver housing 116. In addition, at least a central portion (e.g., an inner rim) of the flexible diaphragm 132 may be attached to the spacer 134, as described in further detail below. The flexible diaphragm 132 may be configured to vibrate when the spacer 134 attached thereto moves in accordance with the movement of one or more components (e.g., the permanent magnet 126 and the yoke cup 130) of the magnet/coil assembly 124 responsive to a magnetic field produced by the voice coil 128 of the magnet/coil assembly 124 upon receiving an audio signal. In some embodiments, the flexible diaphragm 132 is formed of and includes a polymer material (e.g., a plastic).

The spacer 134 may be positioned on or over at least one surface of the magnet/coil assembly 124 so as to partially intervene between the magnet/coil assembly 124 and the flexible diaphragm 132. The spacer 134 may be centrally located relative to a width (e.g., diameter) of each of the upper portion 138 of the yoke cup 130 and the flexible diaphragm 132. For example, as shown in FIG. 1, the spacer 134 may be centrally located on an upper surface 142 of the upper portion 138 of the yoke cup 130, and the flexible diaphragm 132 may be located on at least one surface of the spacer 134.

The spacer 134 is configured to permit movement of one or more components (e.g., the permanent magnet 126 and the yoke cup 130) of the magnet/coil assembly 124 and the spacer 134 is responsive to a magnetic field produced by the voice coil 128 of the magnet/coil assembly 124 upon receiving an audio signal from a media player. In addition, the configuration (e.g., shape, size, and material composition) of the spacer 134 may be selected relative to configurations of other components of the audio driver assembly 110 (e.g., the magnet/coil assembly 124, the flexible diaphragm 132, the driver housing 116, etc.) to provide the audio driver assembly 110 desired acoustic properties (e.g., sensitivity, resonant frequency, SPL profile, etc.), as described in further detail below.

The spacer 134 may be shaped and sized and to facilitate relatively increased upward and downward movement of the flexible diaphragm 132 (upon corresponding movement of the permanent magnet 126 and the yoke cup 130) relative to conventional audio driver assemblies not including the spacer 134. At least a width $W_1$ (e.g., diameter) and a height $H_1$ of the spacer 134 may be selected to form a space 148 exhibiting desirable dimensions between the flexible diaphragm 132 and the upper portion 138 of the yoke cup 130. Depending on the properties (e.g., elastic modulus, stiffness, shape, etc.) of the flexible diaphragm 132, relatively increased dimensions of the space 148 (and, hence, relatively decreased width $W_1$ and/or increased height $H_1$ of the spacer 134) may facilitate relatively increased upward and downward movement (e.g., excursion) of the flexible diaphragm 132. As shown in FIG. 1, the width $W_1$ of the spacer 134 may be less than a width $W_2$ of the upper portion 138 of the yoke cup 130. For example, a ratio of the width $W_1$ of the spacer 134 to the width $W_2$ of the upper portion 138 of the yoke cup 130 may be within a range of about 1:1.5 to about 1:20, such as from about 1:2 to about 1:10, or from about 1:3 to about 1:5. In some embodiments, the ratio of the width $W_1$ of the spacer 134 to the width $W_2$ of upper portion 138 of the yoke cup 130 is about 1:3.

As shown in FIG. 1, in some embodiments, the spacer 134 includes longitudinal projections 144, and at least one lateral projection 146. As used herein, each of the terms "longitudinal" and "vertical" means and includes extending in a direction substantially perpendicular to at least the flexible diaphragm 132, regardless of the orientation of the flexible diaphragm 132. Accordingly, as used herein, each of the terms "lateral" and "horizontal" means and includes extending in a direction substantially parallel to at least the flexible diaphragm 132, regardless of the orientation of the flexible diaphragm 132. The magnet/coil assembly 124 and the flexible diaphragm 132 may each be attached to one or more surfaces of the longitudinal projections 144 and the lateral projection 146, as described in further detail below.

The longitudinal projections 144 of the spacer 134 may be configured (e.g., shaped and sized) to at least partially extend into apertures in the magnet/coil assembly 124 and the flexible diaphragm 132. For example, a first of the longitudinal projections 144 may partially extend into a centrally located aperture 140 in the magnet/coil assembly 124 (e.g., to a location proximate an upper surface of the permanent magnet 126), and a second of the longitudinal projections 144 may at least partially extend in an opposite direction into a centrally located aperture in the flexible diaphragm 132 (e.g., to a location proximate an upper surface of the flexible diaphragm 132). The longitudinal projections 144 may, for example, ensure that the spacer 134 is correctly positioned within the audio driver 118. The magnet/coil assembly 124 and the flexible diaphragm 132 may, optionally, be attached (e.g., adhered, bonded, coupled, etc.) to sidewalls of the longitudinal projections 144. In additional embodiments, at least one of the longitudinal projections 144 may extend to a different depth within at least one of the magnet/coil assembly 124 and the flexible diaphragm 132, and/or at least one of the longitudinal projections 144 may be absent from the spacer 134.

The lateral projection 146 may be configured (e.g., shaped and sized) to extend across an upper surface of the magnet/coil assembly 124 (e.g., the upper surface 142 of the upper portion 138 of the yoke cup 130) and a lower surface of the flexible diaphragm 132. As shown in FIG. 1, less than an entirety of the lateral projection 146 may physically contact the upper surface of the magnet/coil assembly 124 and/or the lower surface of the flexible diaphragm 132. For example, at least one of an upper surface of the lateral projection 146 and a lower surface of the lateral projection 146 may exhibit an arcuate (e.g., concave, convex, etc.) shape, such that elevated portions of the lateral projection 146 physically contact the upper surface of the magnet/coil assembly 124 and/or the lower surface of the flexible diaphragm 132 and recessed portions of the lateral projection 146 do not physically contact the upper surface of the magnet/coil assembly 124 and/or the lower surface of the flexible diaphragm 132. In additional embodiments (e.g., in embodiments where at least one of the upper surface of the lateral projection 146 and the lower surface of the lateral projection 146 exhibits a substantially planar shape), an entirety of the lateral projection 146 may physically contact the upper surface of the magnet/coil assembly 124 and/or the lower surface of the flexible diaphragm 132. The magnet/coil assembly 124 and the flexible diaphragm 132 may, optionally, be attached (e.g., adhered, bonded, coupled, etc.) to one or more portions (e.g., elevated portions) of the lateral projection 146. The lateral projection 146 may, for example, support the flexible diaphragm 132, offset the magnet/coil assembly 124 and flexible diaphragm 132 by the space 148 (e.g., at least partially defined according to the maximum height $H_1$ and width $W_3$ exhibited by the lateral projection 146), and facilitate desired vibration (e.g., upward excursion and downward excursion) of the flexible diaphragm 132 upon the movement of the spacer 134 (and components of the magnet/coil assembly 124).

In additional embodiments, the spacer 134 may exhibit at least one of a different shape and a different size than that depicted in FIG. 1. By way of non-limiting example, the spacer 134 may exhibit a different shape and/or a different size permitting the presence of at least one structure (e.g., at least one rivet) positioned and configured to hold one or more components (e.g., the permanent magnet 126 and the yoke cup 130) of the magnet/coil assembly 124 together.

The spacer 134 may be formed of and include at least one of a polymer material (e.g., a plastic) and metal material (e.g., a metal, a metal alloy, etc.). The material composition of the spacer 134 may be selected to provide the audio driver assembly 110 with desired acoustic properties. As a non-limiting example, a spacer 134 formed of and including a metal material may exhibit lower resonance than a spacer 134 formed of and including a polymer material. As another non-limiting example, a material exhibiting relatively lower stiffness may increase the deflection of the flexible diaphragm 132 as compared to a material exhibiting relatively higher stiffness. In some embodiments, the spacer 134 is formed of and includes plastic. The spacer 134 may be formed using conventional processes (e.g., a molding process, a stamping process, a forging process, a machining process, an extrusion process, a shaping process, combinations thereof, etc.), which are not described in detail herein. In some embodiments, the spacer 134 is formed using a three-dimensional (3D) printing process.

The configuration and position of the spacer 134 within the audio driver 118 may advantageously facilitate the use of at least one of a relatively larger permanent magnet 126 and a relatively larger yoke cup 130 within the magnet/coil assembly 124. Employing the spacer 134 with a relatively larger permanent magnet 126 and/or a relatively larger yoke cup 130 may provide the audio driver 118 with enhanced sensitivity and more moving mass without having to increase the dimensions of the flexible diaphragm 132 to accommodate for the relatively larger permanent magnet 126 and/or the relatively larger yoke cup 130. Increasing the moving mass within the audio driver 118 may, for example, facilitate lower resonant frequencies, such as a bass frequency, which may enhance the listening experience of a user. As used herein, a "bass frequency" is a relatively low audible frequency generally considered to be within the range extending from approximately 16 Hz to approximately 512 Hz.

In operation, current is caused to flow through the voice coil 128, the magnitude of which fluctuates according to the electrical signal carried by the current. The interaction between the magnetic field of the permanent magnet 126 and the fluctuating magnetic field generated by the current flowing through the voice coil 128 results in upward and downward movement (i.e., vibration) of the permanent magnet 126, the yoke cup 130, the spacer 132, and the flexible diaphragm 132 relative to the voice coil 128 and the driver housing 116. The vibrations of the flexible diaphragm 132 result in the emission of audible sound from the flexible diaphragm 132.

Figure 2:
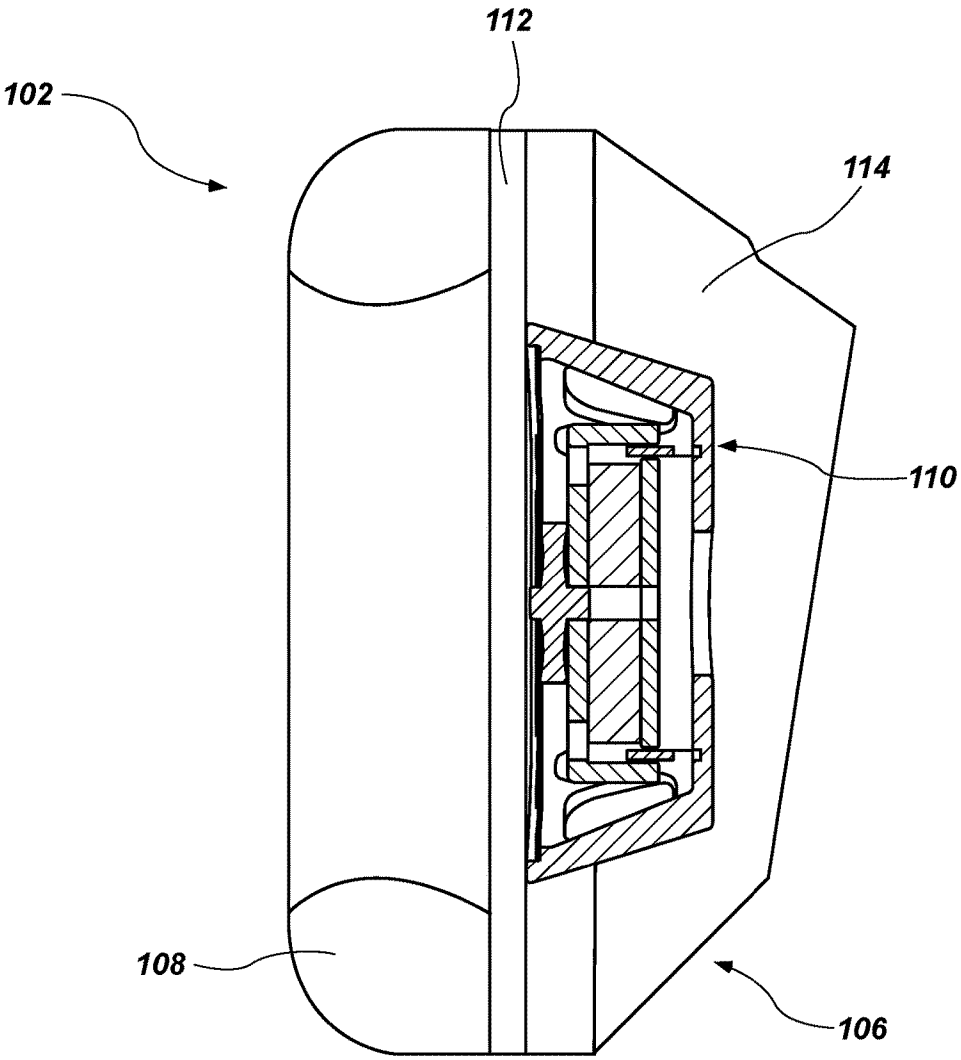
FIG. 2 is a cross-sectional view of an ear-cup assembly including the audio driver assembly of FIG. 1, in accordance with an embodiment of disclosure.

FIG. 2 is a simplified cross-sectional view illustrating the audio driver assembly 110 of FIG. 1 within an ear-cup assembly 102. The ear-cup assembly 102 may include an outer ear-cup housing 106 including at least two members assembled together around the audio driver assembly 110. As a non-limiting example, the outer ear-cup housing 106 may include a front member 112, and a back member 114 connected to the front member 112. The members of the outer ear-cup housing 106 (e.g., the front member 112, the back member 114, etc.) may each independently be formed of and include at least one of a metal material (e.g., a metal, a metal alloy, etc.) and a polymer material (e.g., a plastic), and may serve as a frame structure for the ear-cup assembly 102. The ear-cup assembly 102 may also include a cushion 108 attached to or otherwise carried on the outer ear-cup housing 106.

Figure 3:
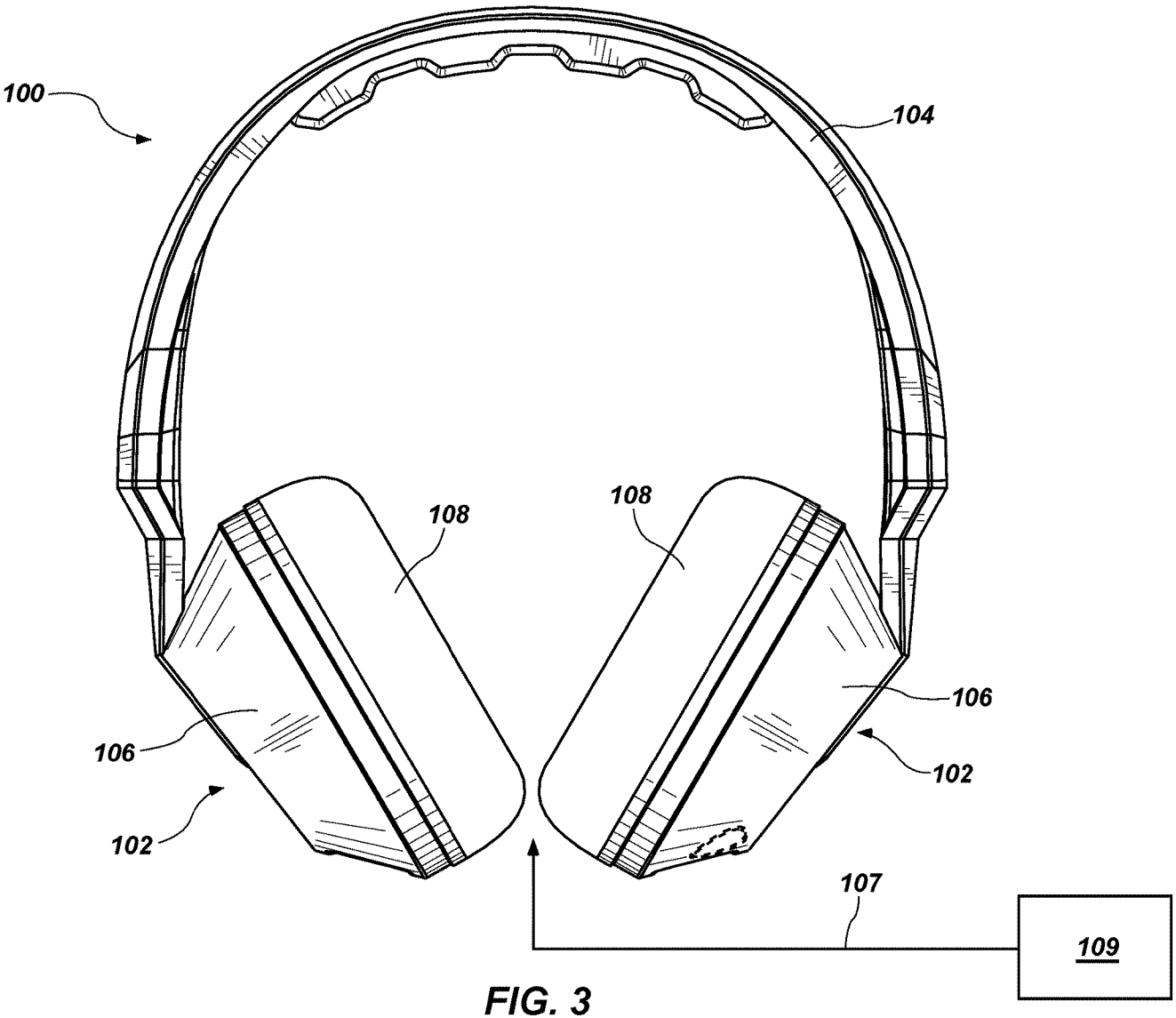
FIG. 3 is a simplified elevation view of a headphone including the ear-cup assembly of FIG. 2, in accordance with an embodiment of disclosure.

FIG. 3 is a simplified elevation view of a headphone 100 including two of the ear-cup assemblies 102 (including the audio driver assemblies 110 thereof) of FIG. 2, and a headband 104 connected to each of the ear-cup assemblies 102. The headband 104 may be configured to rest on the head of a user and to support the ear-cup assemblies 102 on or over the user's ears. The headphone 100 may be configured to receive an electronic audio signal from a media player 109 through a connection 107 (e.g., a wired connection, a wireless connection, etc.) between the headphone 100 and the media player 109. The media player 109 may comprise any device or system capable of producing an audio signal. By way of non-limiting example, the media player 109 may comprise a portable digital music player, a portable compact disc player, a portable cassette player, a mobile phone, a smartphone, a personal digital assistant (PDA), a radio (e.g., AM radio, FM radio, HD radio, satellite radio, etc.), a television, an ebook reader, a portable gaming system, a portable DVD player, a laptop computer, a tablet computer, a desktop computer, a stereo system, and/or other devices or systems capable of transmitting electronic audio signal to the headphone 100.

While the disclosure is susceptible to various modifications and alternative forms, specific embodiments have been shown by way of example in the drawings and have been described in detail herein. However, the disclosure is not limited to the particular forms disclosed. Rather, the disclosure is to cover all modifications, equivalents, and alternatives falling within the scope of the disclosure as defined by the following appended claims and their legal equivalents.

What is claimed is:

1. An audio driver assembly, comprising:

a driver housing; and an audio driver secured within the driver housing and comprising:

a magnet assembly exhibiting an aperture extending therethrough;

a flexible diaphragm overlying the magnet assembly and exhibiting another aperture extending therethrough; and a spacer between the magnet assembly and the flexible diaphragm and exhibiting at least one lateral projection extending across an upper surface of the magnet assembly and a lower surface of the flexible diaphragm, the spacer discrete from the magnet assembly and the flexible diaphragm and longitudinally projecting into the aperture in the magnet assembly and the another aperture in the flexible diaphragm.

2. The audio driver assembly of claim 1, wherein the magnet assembly comprises:

a permanent magnet;

a voice coil circumscribing the permanent magnet; and a yoke cup at least partially surrounding the permanent magnet and the voice coil.

3. The audio driver assembly of claim 2, wherein the yoke cup comprises:

a lower portion underlying a lower surface of the permanent magnet;

an upper portion overlying an upper surface of the permanent magnet and at least partially extending over and surrounding peripheral sidewalls of each of the permanent magnet and the lower portion of the yoke cup.

4. The audio driver assembly of claim 3, wherein at least portion of the voice coil is located within a cavity at least partially defined by inner sidewalls of the upper portion of the yoke cup and the peripheral sidewalls of each of the permanent magnet and the lower portion of the yoke cup.

5. The audio driver assembly of claim 1, wherein the spacer directly physically contacts an upper surface of the magnet assembly and a lower surface of the flexible diaphragm.

6. The audio driver assembly of claim 1, wherein the spacer is located adjacent central portions of each of the magnet assembly and the flexible diaphragm.

7. The audio driver assembly of claim 1, wherein the spacer comprises at least one of a metal material and a polymer material.

8. The audio driver assembly of claim 1, wherein a longitudinal projection of the spacer terminates proximate an upper surface of a permanent magnet of the magnet assembly.

9. The audio driver assembly of claim 1, wherein less than an entirety of the at least one lateral projection directly physically contacts each of the upper surface of the magnet assembly and the lower surface of the flexible diaphragm.

10. The audio driver assembly of claim 9, wherein the at least one lateral projection exhibits elevated regions and recessed regions, only the elevated regions in direct physical contact with each of the upper surface of the magnet assembly and the lower surface of the flexible diaphragm.

11. The audio driver assembly of claim 1, wherein an inner rim of the flexible diaphragm defined by the another aperture extending through the flexible diaphragm is attached to the spacer, and an outer rim of the flexible diaphragm is attached to the driver housing.

12. A headphone, comprising:

an ear-cup housing; and an audio driver assembly disposed at least partially within the ear-cup housing, the audio driver assembly comprising:

a driver housing;

a flexible diaphragm suspended from the driver housing and exhibiting an aperture extending therethrough;

a magnet assembly underlying the diaphragm and exhibiting another aperture extending therethrough, the magnet assembly comprising:

a permanent magnet;

a voice coil circumscribing the permanent magnet; and a yoke cup at least partially surrounding the permanent magnet and the voice coil; and a spacer between the flexible diaphragm and the magnet assembly and exhibiting at least one lateral projection extending across an upper surface of the magnet assembly and a lower surface of the flexible diaphragm, the spacer discrete from the flexible diaphragm and the magnet assembly and longitudinally projecting into the aperture in the flexible diaphragm and the another aperture in the magnet assembly.

13. The headphone of claim 12, wherein the spacer directly physically contacts central portions of each of the flexible diaphragm and an upper portion of the yoke cup of the magnet assembly.

14. The headphone of claim 12, wherein a portion of the spacer extends into an aperture in the magnet assembly and another portion of the spacer extends into another aperture in the flexible diaphragm substantially aligned with the aperture in the magnet assembly.

15. The headphone of claim 12, wherein the spacer comprises plastic.

16. The headphone of claim 12, wherein the spacer is centrally located relative to a width of each of the magnet assembly and the flexible diaphragm.

17. The headphone of claim 12, wherein the driver housing exhibits at least one aperture substantially aligned with at least one aperture in the magnet assembly.

18. A method of forming a headphone, comprising:

forming an audio driver assembly, the audio driver assembly comprising:

a driver housing;

a flexible diaphragm suspended from the driver housing and exhibiting an aperture extending therethrough;

a magnet assembly underlying the diaphragm and exhibiting another aperture extending therethrough, the magnet assembly comprising:

a permanent magnet;

a voice coil circumscribing the permanent magnet; and a yoke cup at least partially surrounding the permanent magnet and the voice coil; and a spacer between the flexible diaphragm and the magnet assembly and exhibiting at least one lateral projection extending across an upper surface of the magnet assembly and a lower surface of the flexible diaphragm, the spacer discrete from the flexible diaphragm and the magnet assembly and longitudinally projecting into the aperture in the flexible diaphragm and the another aperture in the magnet assembly; and attaching the audio driver assembly within an ear-cup housing.

* * * * *